United States Patent [19]

Tasedan

[11] 4,333,277

[45] Jun. 8, 1982

[54] COMBINATION SAND-BLASTING AND VACUUM APPARATUS

[76] Inventor: Robert T. Tasedan, 562 Joann, A, Costa Mesa, Calif. 92627

[21] Appl. No.: 172,776

[22] Filed: Jul. 28, 1980

[51] Int. Cl.[3] ..... B24C 3/02

[52] U.S. Cl. ..... 51/425; 51/427; 51/438

[58] Field of Search ..... 51/424, 425, 426, 427, 51/438, 439, 410, 321, 270, 273; 239/103, 104, 121

[56] References Cited

U.S. PATENT DOCUMENTS

| | | | |
|---|---|---|---|
| 2,332,281 | 10/1943 | Van der Pyl | 51/439 |
| 2,455,514 | 12/1948 | Mead | 51/425 |
| 2,723,498 | 11/1955 | Hastrup et al. | 51/425 |
| 2,840,955 | 7/1958 | Hastrup et al. | 51/425 |
| 3,624,967 | 12/1971 | Kamper et al. | 51/425 |

*Primary Examiner*—Nicholas P. Godici
*Assistant Examiner*—Robert A. Rose
*Attorney, Agent, or Firm*—Francis X. LoJacono

[57] ABSTRACT

A sand-blasting apparatus which is operated by a vacuum system, wherein there is provided a sand-blasting gun having an air-inlet passage and a sand-inlet passage. Air is discharged into a mixing chamber, creating a vacuum therein to suck sand through the sand-inlet passage, and to discharge the sand under high-velocity so as to impinge against the surface to be sanded, the sand being captured within the enclosed discharge end of the gun and then returned to the sand-storage tank under a return vacuum arrangement defined by a continuous low-vacuum flow and a controlled high-vacuum flow, the high-vacuum flow being activated when the trigger valve of the gun is operated.

6 Claims, 5 Drawing Figures

COMBINATION SAND-BLASTING AND VACUUM APPARATUS

BACKGROUND OF THE INVENTION

1. Field of the Invention

This invention relates generally to a sand-blasting device, and more particularly to a sand-blasting apparatus which is provided with a unique return-vacuum system that includes both a continuous low-pressure return vacuum and a selective high-pressure vacuum.

2. Description of the Prior Art

As is well known in the art, various problems and difficulties are encountered in providing suitable means for establishing a clean-air environment while sand-blasting, especially in closed or confined areas.

There are several types of known sand-blasting systems; however, these devices have features that restrict their use to certain sand-blasting conditions and circumstances. Many of the known devices are complicated to operate, often requiring two or more operators, and others are prohibitively expensive to maintain, particularly under limited use.

Accordingly, high-pressure sand-blasting equipment very often requires a water mixture which cannot be used in closed or confined areas. Some sand-blasting devices have various means for saving the used sand so as to be recycled. However, to the applicant's knowledge, there is no device of the character herein disclosed that overcomes many of the existing problems inherent in known sand-blasting apparatuses.

SUMMARY OF THE INVENTION

The present invention provides a new and unique sand-blasting apparatus which includes a vacuum system that allows for a constant return flow of discharged sand back to its storage tank, whereby a closed discharge-and-return system is created during the sand-blasting operation.

Thus, it is an important object of this invention to provide a clean-air environment for the operator and the surrounding area, whether it be a closed or open work area. This clean environment is established by a continuous low-vacuum condition and a selective high-pressure vacuum condition. That is, when the sand-blasting gun is operated, the impinging sand is automatically returned to its storage tank to be recycled. However, when the operative trigger valve is released, a continuous low-vacuum condition allows the remaining sand and residue to be sucked rearwardly from the gun until the compressor itself is turned off, or the line is disconnected.

It is, therefore, another object of the invention to provide a sand-blasting apparatus that includes a unique dual-vacuum arrangement, not provided before in known systems.

It is still another object of the invention to provide a resilient cup member adapted to enclose the front-discharge end of the gun, to prevent and control the displacement of the discharging sand so that it can be readily vacuumed through a return hose to the storage tank.

It is a further object of the invention to provide a sand-blasting apparatus of this character that has relatively few operating parts.

It is still a further object of the present invention to provide an apparatus of this character that is simple to service and maintain.

Still another object of the invention is to provide a device of this character that is inexpensive to manufacture, yet is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
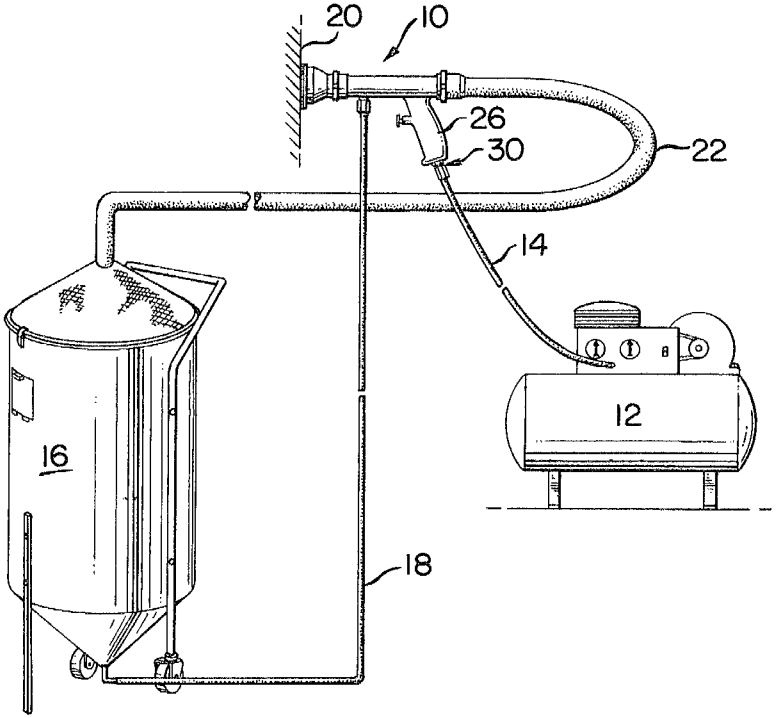
FIG. 1 is a schematic diagram of the sand-blasting apparatus in combination with a dual-vacuum system having a storage tank and a compressor unit.

Referring to the drawings and more particularly to FIG. 1, there is illustrated a schematic view of a sand-blasting gun, generally indicated at 10, being connected to an air compressor 12, of any known suitable type, by means of hose 14. Thus, air under pressure between eighty to one-hundred-fifty pounds is supplied to gun 10, there being a means in the gun to create a vacuum to cause sand to flow from the storage tank 16, through an interconnecting flow line 18, and into the forward portion of gun 10, where it is propelled outwardly therefrom to impinge on a work surface 20.

After the sand strikes the work surface and it loses its forward velocity, the sand and debris is vacuumed rearwardly through the gun housing and through flexible tube 22, the tube 22 being interconnected between gun 10 and storage tank 16.

It is important to note that the return-vacuum operation includes a dual-vacuum arrangement, whereby a continuous low vacuum, together with a controlled high vacuum, is established. The low vacuum occurs while the compressor 12 is in operation; and the high vacuum is provided during the actual sand-blasting operation. A more detailed description will hereinafter be provided.

Figures 2, 3, 5:
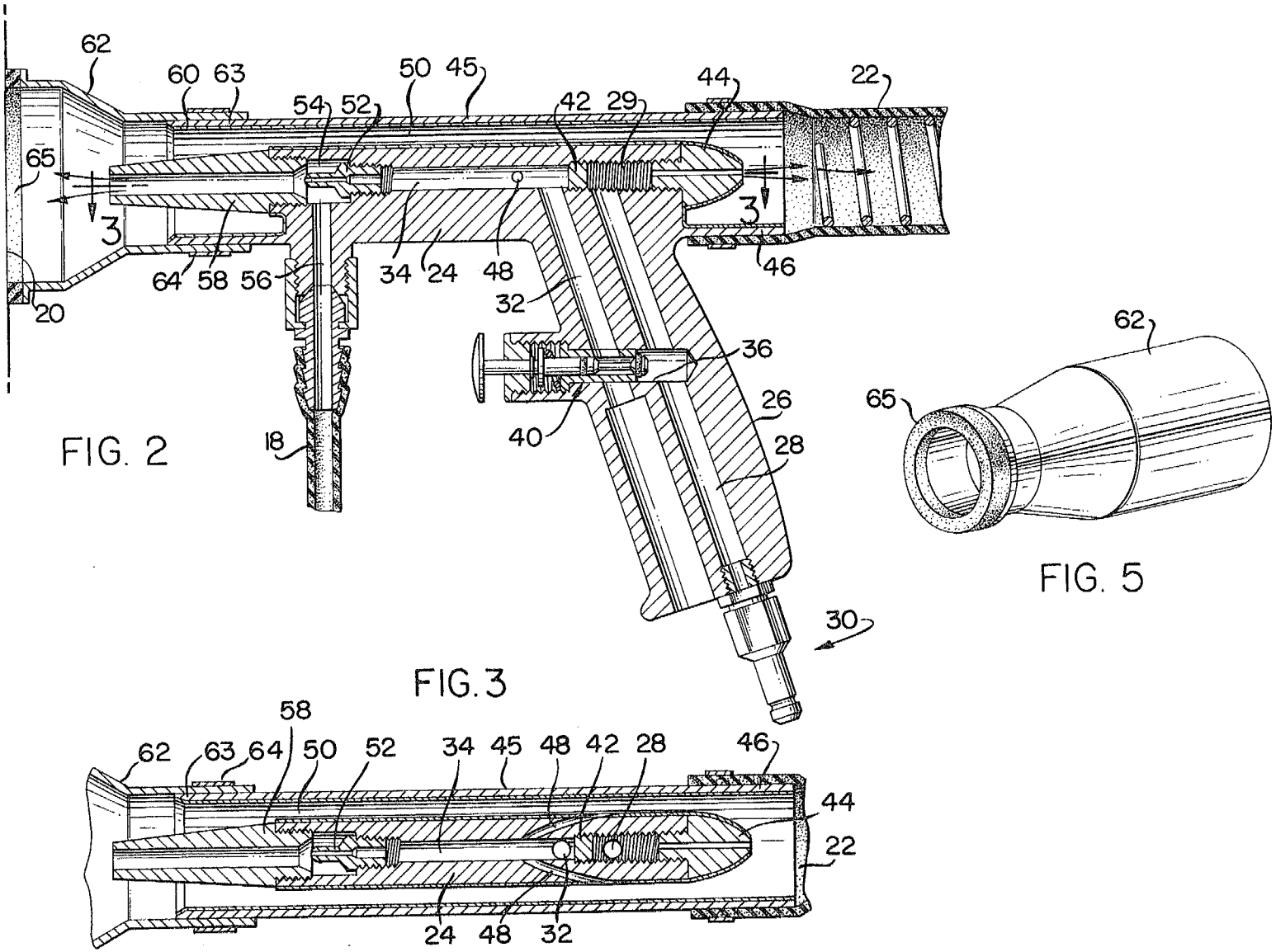
FIG. 2 is a longitudinal cross-sectional view of the sand-blasting gun as it would be positioned against a work surface.
FIG. 3 is a cross-sectional view taken substantially along line 3—3 of FIG. 2.
FIG. 5 is a perspective view of an alternative arrangement of a protective cup member which is interchangeable about the discharge end of the gun.

Referring now to FIGS. 2 and 3, the sand-blasting gun 10 comprises a main body 24 having an integrally formed handle 26. The handle includes an air-inlet passage 28 extending the full length of handle 26 and terminating into a rear-discharge bore 29 disposed longitudinally in the rear of the gun body 24. The opposite end of the inlet passage 28 is adapted to receive a coupling means 30 for removably connecting pressure hose 14 from compressor 12. A secondary inlet passage 32 is included in the upper portion of handle 26 which has one end thereof terminating in a second longitudinal air passage 34 formed in body 24. The opposite end of the secondary inlet passage is operably connected to inlet passage 28 by a lateral transverse passage 36 which is adapted to receive a control-valve means 40. Thus, air under pressure is allowed to enter the secondary passage 32 only when valve means 40 is operated.

Accordingly, when compressor 12 is operating, a continuous flow of air is received through inlet passage 28 and into rear bore 29, bore 29 being threaded to receive plug 42 which is positioned to seal off air passage 34 and to receive rear air-discharge nozzle 44. Thus, air is continuously discharged rearwardly of the gun and rearwardly outward from the gun sleeve which defines tubular housing 45. The tubular housing extends outwardly from the front and rear portions of the gun body 24. The rearwardly extended portion 46 of sleeve 45 is adapted to receive one end of flexible tube 22 which returns the sand to storage tank 16, as seen in FIG. 1. The arrangement of a continuous rearward flow of air pressure will create a vacuum condition within sleeve 45, the vacuum being continuous as long as the compressor is operating.

However, air does not pass into passages 32 and 34 until valve 40 is opened. As air under pressure passes through passage 34, two operations will occur. In the first operation, air will exit through rearwardly positioned orifices 48, as seen in FIG. 3. Thus, each time the trigger-valve means 40 is operated, air is discharged through orifices 48, at which time an additional vacuum is created in the sleeve chamber 50 of sleeve 45. Accordingly, as the sand-blasting operation is in progress, the sand and the debris is vacuumed through chamber 50 and into vacuum tube 22. In the second operation, compressed air from longitudinal passage 34 discharges forwardly through a front-discharge nozzle 52, the discharge nozzle being positioned in a mixing chamber 54. The mixing chamber is interposed between sand-inlet passage 56 and the sand-discharge nozzle 58. When trigger valve 40 is opened, air under pressure (generally between eighty to one-hundred-fifty pounds) passes out from air nozzle 52, thereby creating a vacuum in chamber 54. This causes sand to be carried from tank 16 through flow line 18 in the chamber 54, and to be mixed with the discharging air, whereby the sand particles are ejected through nozzle 58 to impinge on the work surface.

The protruding front portion 60 of sleeve 45 is provided with a catch means which comprises a cup-like housing 62 formed from a preferably resilient material, one end thereof being secured to sleeve portion 63 by a suitable clamp 64, and the opposite end being provided with a resilient annular-seal member 65 to be pressed against surface 20. This cup arrangement captures the used sand and allows it to be sucked back under vacuum to tank 16.

It is important to note that, when trigger valve 40 is released and closed, a vacuum is still being provided by the continuous air flow out of rear air nozzle 44; and thus all residue left in cup 62, after blasting is completed, is also sucked through sleeve 45.

FIG. 5 illustrates another embodiment of the sand-collecting cup-like housing, whereby various configurations of such housings can be provided for the various sand-blasting work areas and workpieces.

It is further contemplated that sand-blasting nozzle 58 will be formed from a suitable resistive material such as ceramic. All of the inner exposed surfaces of the gun will also be coated with a suitable abrasive-resistant coating. Hence, the wear to the gun structure will be minimal.

Figure 4:
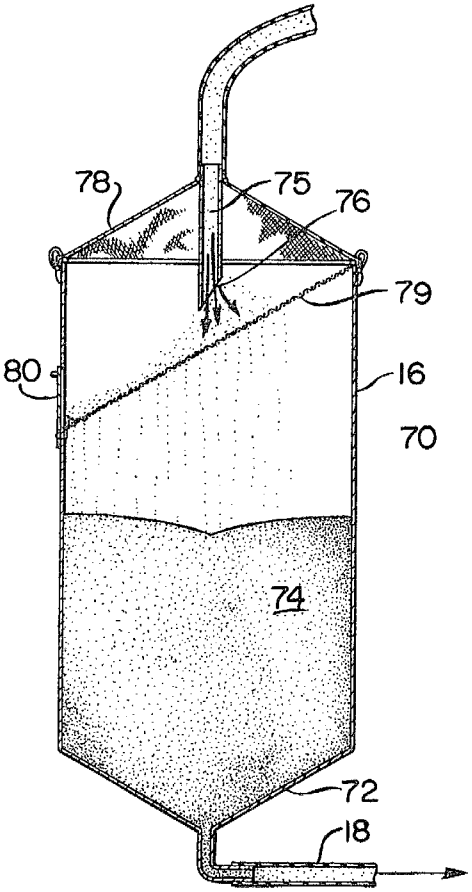
FIG. 4 is a cross-sectional view of the storage tank for the sand, showing the return-flow inlet and the discharge outlet at the bottom of tank.

Various types of storage tanks can be employed within the vacuum system; however, in FIG. 4, there is shown in detail a storage tank 16 having a cylindrical wall defining a housing 70 which includes an annular angular bottom wall 72 having an outlet member connected with flow line 18. Thus, sand 74 is vacuumed from the bottom of tank 16, and the used sand is then returned to tank 16 by way of inlet conduit 75 having a beveled discharge end 76. Tank 16 includes a closure cover 78 preferably of a cloth material that is removably supported thereon. As the spent sand is returned, it must pass through screen 78 in order to separate large particles sanded from the workpiece. These particles can be readily removed through door 80 located at the lower portion of the inclined screen 79. Sand 74 flows in an almost closed-loop vacuum-and-blasting system.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form or uses mentioned, except as defined in the accompanying claims.

I claim:

1. A sand-blasting apparatus, including a compressor and a storage tank, comprising:

a sand-blasting gun having an air-inlet passage and a sand-inlet passage, and including a longitudinal cylindrical housing provided with front and rear open ends;

a first means in said gun to provide a continuous rearward air flow to establish a continuous vacuum in a rearward direction through said cylindrical housing;

a second means in said gun to provide a selective rear air flow to establish a secondary selective vacuum in a rearward direction through said cylindrical housing;

a trigger-valve means to control air flow to said secondary vacuum means, and interposed between said secondary vacuum means and said air-inlet passage;

an air-and-sand-mixing-vacuum chamber;

a front air-discharge nozzle positioned within said air-and-sand-mixing-vacuum chamber;

a sand-discharge nozzle attached to said gun, and projecting from said front open end of said housing; and means to enclose said sand-discharge nozzle to confine the sand between said gun and the surface of the workpiece being sanded, whereby sand in said enclosure is vacuumed therefrom;

wherein said first means to establish a continuous vacuum comprises:

a rear discharge bore formed in said gun and positioned to communicate with said air-inlet passage; and a rear air-discharge nozzle mounted in said bore, wherein said rear air-discharge nozzle is disposed adjacent said rear open end of said cylinder; and wherein said second means to establish a selective secondary vacuum comprises:

a second air passage disposed between said trigger-valve means and said front air-discharge nozzle, said second air passage communicating with said air-inlet passage when said trigger-valve means is operated; and a pair of discharge orifices communicating between said second air passage and said housing, said orifices being disposed angularly and rearwardly of said second air passage, to establish a rearward vacuum when said trigger-valve means is operated.

2. A sand-blasting apparatus as recited in claim 1, wherein said enclosure means is affixed to said cylindrical housing and comprises a resilient cup-like body member having an open end adapted to engage the surface of a workpiece.

3. A sand-blasting apparatus as recited in claim 2, wherein said resilient cup-like body includes a resilient annular seal member.

4. A sand-blasting apparatus as recited in claim 2, wherein the inner surface of said cylindrical housing and the surface of said cylindrical housing and the surface of said gun disposed in said housing is covered by a wear-resistant material.

5. A sand-blasting apparatus as recited in claim 1, wherein said apparatus includes:

a vacuum-return flexible tube interconnected between said sand-blasting gun and said storage tank;

air hose interconnected between said compressor and said air-inlet passage; and a flow line connected between said gun and said storage tank, whereby sand passes therethrough.

6. A sand-blasting apparatus as recited in claim 5, wherein said storage tank comprises:

a housing having an outlet member connected to said flow line and the bottom of said housing, and an inlet conduit having a beveled discharge end connected to said vacuum tube at the top of said tank;

a removable closure cover mounted to said tank; and a screen angularly positioned within said storage tank below said beveled discharge end of said inlet conduit.

* * * * *